US012570488B2

(12) United States Patent
Kim

(10) Patent No.: US 12,570,488 B2
(45) Date of Patent: Mar. 10, 2026

(54) PAPER FEED SYSTEM

(71) Applicant: A4 HOUSE CO., LTD., Seoul (KR)

(72) Inventor: Hong Min Kim, Seoul (KR)

( * ) Notice: Subject to any disclaimer, the term of this patent is extended or adjusted under 35 U.S.C. 154(b) by 290 days.

(21) Appl. No.: 18/272,311

(22) PCT Filed: Nov. 1, 2021

(86) PCT No.: PCT/KR2021/015497

§ 371 (c)(1),
(2) Date: Jul. 13, 2023

(87) PCT Pub. No.: WO2022/169067

PCT Pub. Date: Aug. 11, 2022

(65) Prior Publication Data

US 2024/0083700 A1 Mar. 14, 2024

(30) Foreign Application Priority Data

Feb. 4, 2021 (KR) ..... 10-2021-0015865

(51) Int. Cl.
*B65H 1/20* (2006.01)
*B65H 1/14* (2006.01)
*B65H 7/04* (2006.01)

(52) U.S. Cl.
CPC ..... *B65H 1/20* (2013.01); *B65H 1/14* (2013.01); *B65H 7/04* (2013.01); *B65H 2403/30* (2013.01); *B65H 2403/52* (2013.01); *B65H 2511/416* (2013.01)

(58) Field of Classification Search
CPC ... B65H 1/14; B65H 1/20; B65H 7/04; B65H 2403/52; B65H 2405/15; B65H 2553/80
See application file for complete search history.

(56) References Cited

U.S. PATENT DOCUMENTS 6,798,997 B1 * 9/2004 Hayward ..... G06Q 30/0605 399/24
2015/0115523 A1 * 4/2015 Yamaguchi ..... B65H 1/14 271/162
2024/0327147 A1 * 10/2024 Kim ..... B65H 1/14

FOREIGN PATENT DOCUMENTS

JP H07-251953 A 10/1995
JP 2005-112549 A 4/2005
JP 2007-101966 A 4/2007
(Continued)

*Primary Examiner* — Howard J Sanders
(74) *Attorney, Agent, or Firm* — KORUS Patent, LLC; Seong Il Jeong

(57) ABSTRACT

The present invention is directed to a paper feed system. The paper feed system includes: a paper feed apparatus configured to accommodate stacked paper and sense a paper shortage state and a paper replenishment completion state; a communication unit provided to be integrated with or correspond to the paper feed apparatus, and configured to transmit a paper replenishment request signal when the paper feed apparatus senses a paper shortage state and transmit a paper replenishment completion signal when the paper feed apparatus senses a paper replenishment completion state; and a first server configured to communicate with the communication unit. When a change in the weight of stacked paper is detected, a paper support plate is elevated by driving a motor. When a situation in which the paper support plate reaches a set remaining amount height, a paper shortage state signal is transmitted to feed paper.

8 Claims, 5 Drawing Sheets

(56) References Cited

FOREIGN PATENT DOCUMENTS

| | | | |
|---|---|---|---|
| JP | 2013-184755 | A | 9/2013 |
| KR | 10-1223959 | B1 | 1/2013 |

* cited by examiner

PAPER FEED SYSTEM

TECHNICAL FIELD

The present invention relates to a paper feed system, and more particularly, to a paper feed system capable of automatically recognizing a paper shortage state and then replenishing paper without a need for a user to separately determine the amount of remaining paper in a state in which a large amount of paper is stacked.

BACKGROUND ART

Paper for offices (e.g., A4 paper) widely used in companies or government offices is packaged in units of hundreds of sheets, and the paper packaged in small size as described above is boxed again in bundle forms and fed to consumers. When using the packaged paper, the consumers dismantle the box packaging, peel off packaging paper, and then fill a printer, a copier, or an all-in-one printer with the paper.

In using paper, consumers generally do not keep track of the amount of remaining paper after purchasing paper on a per-box package or small-sized package basis. Accordingly, when a printer, a copier, or an all-in-one printer runs out of paper, the consumers first look for small-packaged or box-packaged paper to fill paper. If there is no paper or there is not sufficient paper left at that time, consumers will purchase or order paper from an online or offline store. Users always purchase or order paper on a per-box basis in order to avoid a paper shortage.

Therefore, there is a demand for a scheme capable of, in the feed of paper, reducing the above-described costs or waste of human and material resources attributable to the double packaging composed of small-sized packaging of hundreds of sheets using packaging paper and bundled box packaging and also reducing the above-described inconvenience in which consumers keep track of the amount of remaining paper and then order or purchase paper.

DISCLOSURE

Technical Problem

The present invention has been conceived to overcome the problems of the prior art, and an object of the present invention is to provide a convenient paper feed system that can reduce the costs and waste of resources attributable to conventional double packaging composed of small-sized unit packaging and box packaging in the feed of paper for offices and prevent a consumer from having to keep track of the amount of remaining paper.

Technical Solution

The above-described object of the present invention may be achieved by a paper feed system including: a paper feed apparatus configured to accommodate stacked paper and sense a paper shortage state and a paper replenishment completion state; a communication unit provided to be integrated with or correspond to the paper feed apparatus, and configured to transmit a paper replenishment request signal when the paper feed apparatus senses a paper shortage state and transmit a paper replenishment completion signal when the paper feed apparatus senses a paper replenishment completion state; and a first server configured to communicate with the communication unit over a communication network; wherein the paper feed apparatus includes: a main body configured such that a paper outlet is formed in the upper part of a front side thereof, a space is formed therein, and a door configured to be selectively opened and closed is formed in the front side thereof, a paper support plate formed in a plate shape so that paper is stacked and supported thereon; an elevation unit installed inside the main body, and configured to selectively elevate and lower the paper support plate; a power unit mounted in the lower part of the main body, and configured to move the paper support plate; a sensor configured to measure the weight of the paper stacked on the paper support plate; and a controller configured to control the driving of the power unit in conjunction with the sensor.

The paper feed system may further include a second server configured to communicate with the first server over a communication network, and the first server may transmit a paper feed service provision signal to the second server when receiving the paper replenishment request signal from the communication unit.

The elevation unit may include: a plurality of guide rails formed inside the main body in a vertical direction; a plurality of guide rods formed inside the main body 100 in a vertical direction, and arranged in parallel with the guide rails; and a multi-stage screw formed under the paper support plate.

A plurality of bushings configured to be fitted around the guide rods may be formed in the paper support plate, and insertion recesses configured to be coupled to the guide rails may be formed in the paper support plate.

The multi-stage screw may include: a first-stage screw connected to a driven pulley, and provided with a thread that is formed on the outer circumferential surface thereof, a second-stage screw screwed to the first-stage screw, and provided with a thread that is formed on the outer circumferential surface thereof, a third-stage screw screwed to the second-stage screw, and provided with a thread that is formed on the outer circumferential surface thereof, and a screw housing screwed to the outside of the third-stage screw, and provided with a top end that is fixed to the paper support plate.

The power unit may include: a motor mounted in the lower part of the main body, and provided with a driving pulley; the driven pulley formed at the lower end of the multi-stage screw; and a chain configured to connect the driving pulley and the driven pulley.

When the sensor detects a change in the weight of the stacked paper, the controller may elevate the paper support plate in association with a moving distance calculated according to a reduction in weight by driving the motor to extend the multi-stage screw.

The controller may further include a height detecting unit configured to detect whether the paper support plate reaches a desirably set remaining amount height, and the controller may transmit a paper shortage signal to the communication unit when the height detection unit detects a situation in which the paper support plate reaches the set remaining amount height.

The first server may transmit a paper payment request signal to the communication unit in response to the paper replenishment request signal when receiving the paper replenishment request signal from the communication unit.

The first server may transmit a paper feed service provision signal to the second server when receiving the paper replenishment request signal from the communication unit.

The paper feed system may further include a second server configured to communicate with the first server over a communication network, and the first server may transmit a paper payment request signal to the communication unit in response to the paper replenishment request signal when receiving the paper replenishment request signal from the communication unit, and transmit a paper feed service provision signal to the second server when determining that payment is completed in response to the paper payment request signal.

Advantageous Effects

According to the present invention, there is provided a paper feed system of a new concept capable of automatically identifying and feeding the amount of remaining paper, so that there can be provided the effects of reducing the costs and waste of resources attributable to conventional small-sized unit packaging and box packaging and providing convenience to a consumer.

In addition, there is an effect that can contribute to the prevention of environmental contamination because there is no need for separate manufacturing and waste disposal of small-sized unit packaging paper for the packaging of hundreds of sheets of paper and box packaging paper for box packaging.

MODE FOR INVENTION

The disclosed paper feed apparatus automatically identifies the amount of remaining stacked paper for offices and supplies paper, thereby promoting the convenience of a consumer in the management of paper for offices and reducing the costs and waste of resources attributable to conventional small-sized unit packaging and box packaging.

Hereinafter, embodiments will be described in detail with reference to the accompanying drawings. However, since to the embodiments may be subjected to various modifications, the range of rights of the patent application is not limited or restricted by these embodiments. It should be understood that all modifications, equivalents and/or substitutes to the embodiments fall within the range of rights.

Specific structural or functional descriptions of the embodiments are disclosed for illustrative purposes only, and the embodiments may be modified and implemented in various forms. Accordingly, the embodiments are not limited to the specific disclosed forms, and the scope of the present specification includes changes, equivalents, and/or substitutes included in the technical spirit.

Although terms such as first or second may be used to describe various components, such terms should each be construed only for the purpose of distinguishing one component from another. For example, a first component may be termed a second component, and similarly, a second component may be termed a first component.

Figure 1:
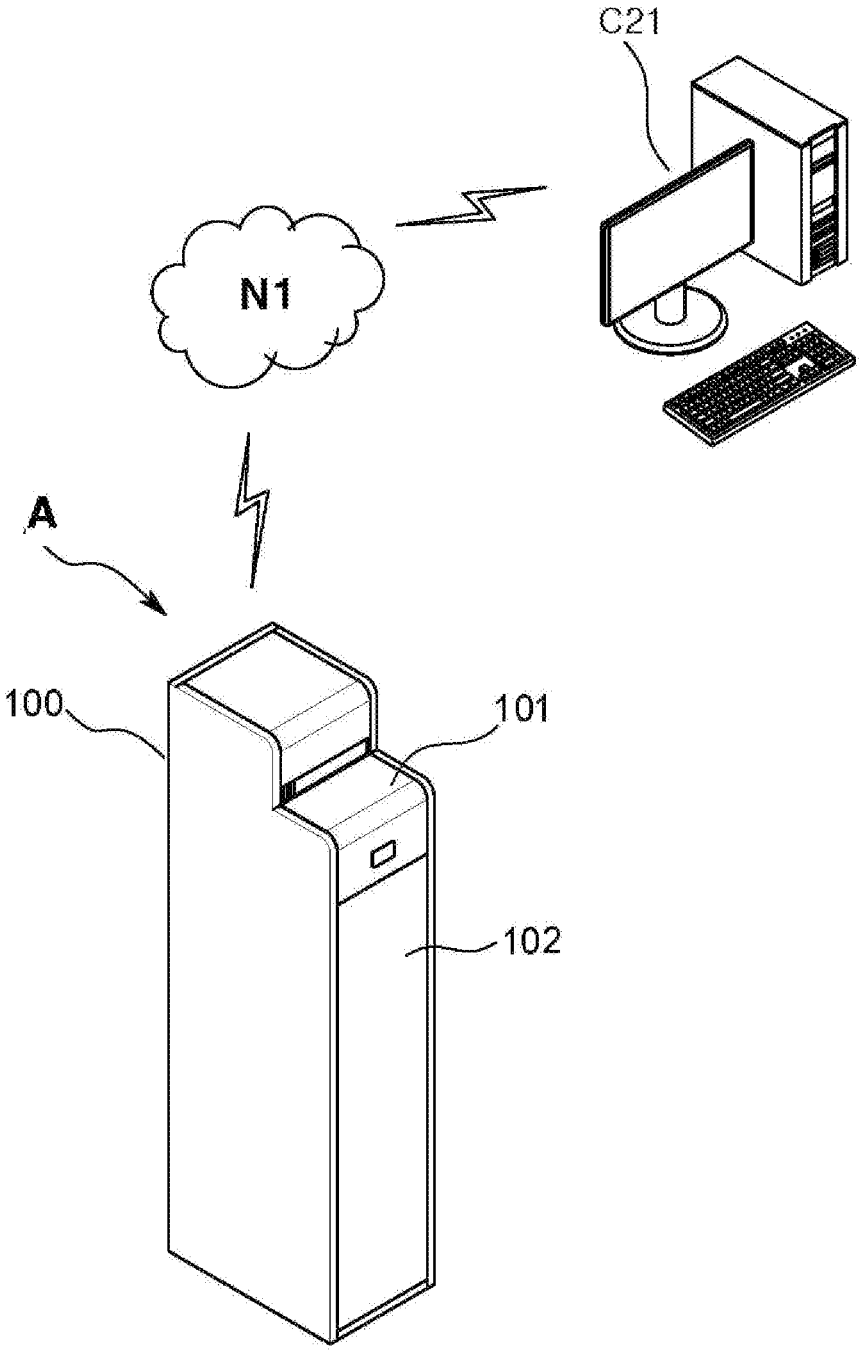
FIG. 1 is a perspective view showing a paper feed apparatus according to the present invention.
Figure 2:
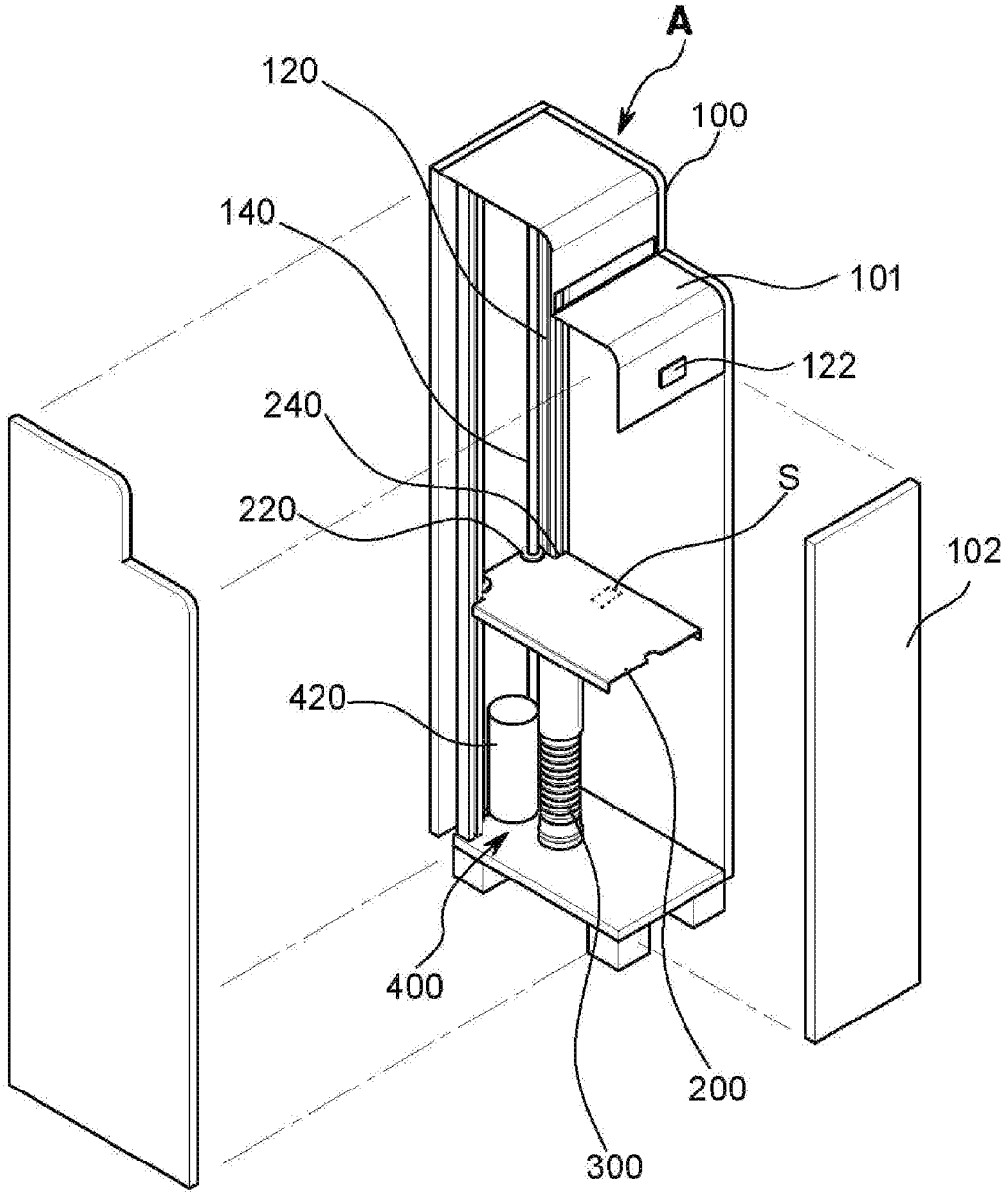
FIG. 2 is an exploded perspective view showing the paper feed apparatus according to the present invention.
Figure 3:
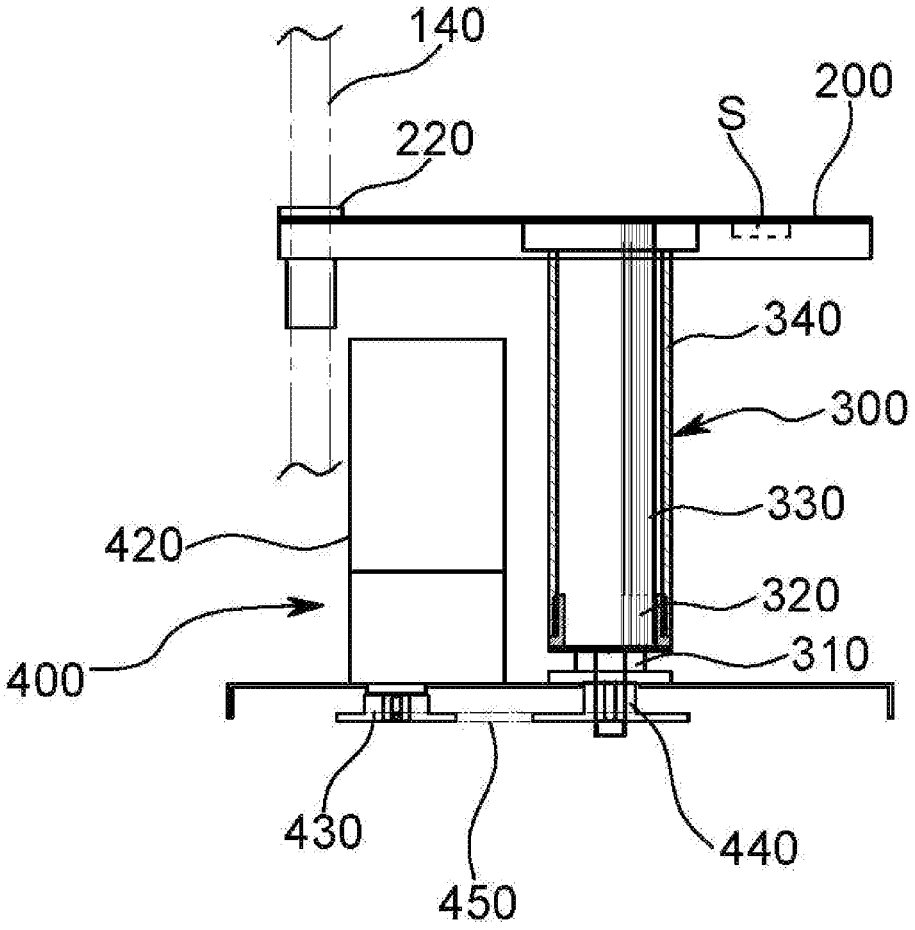
FIG. 3 is a view showing the 'power unit' of the paper feed apparatus according to the present invention.
Figure 4:
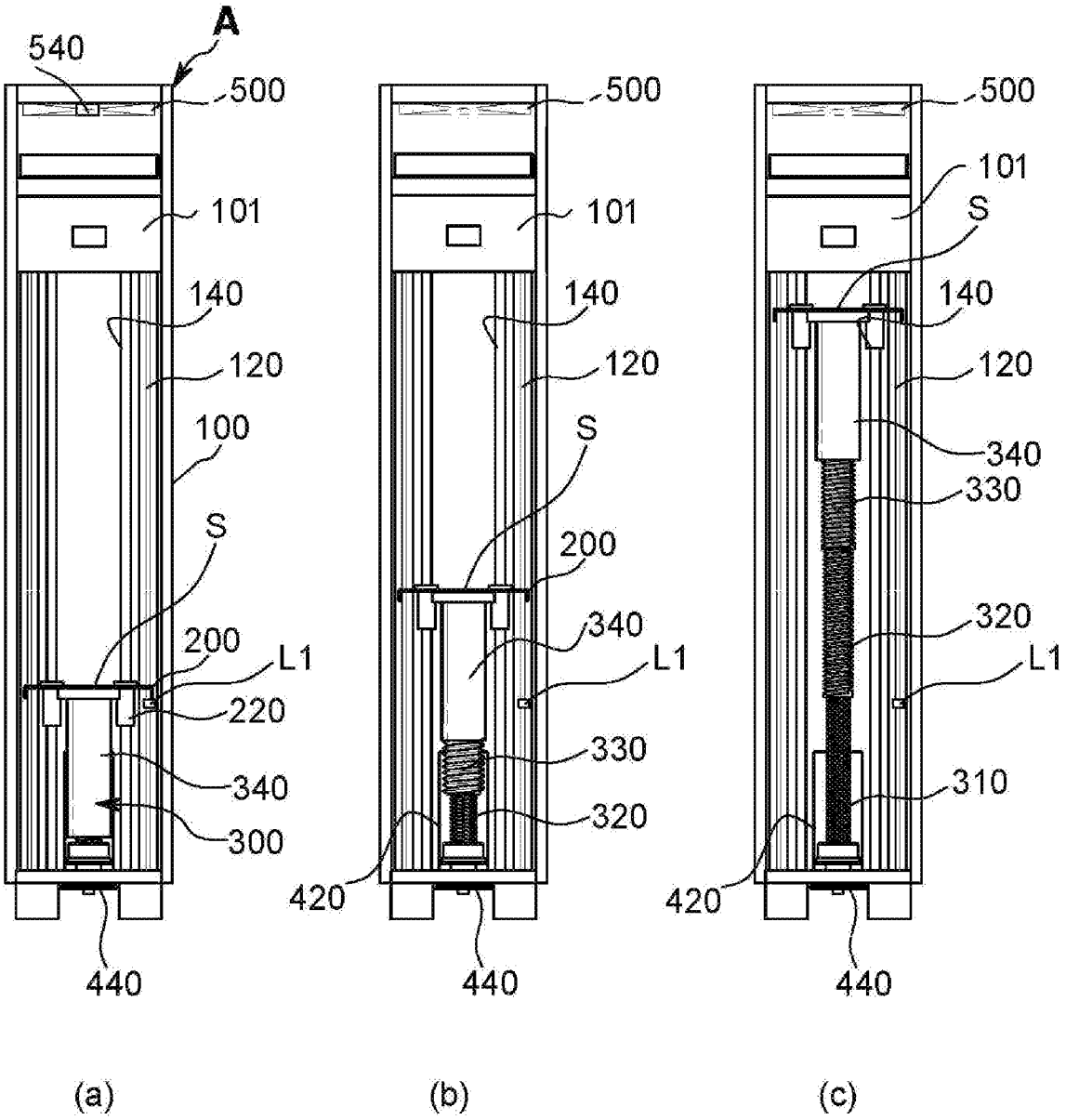
FIGS. 4A-4C are front views showing the lifting operation of the 'paper support plate' of the paper feed apparatus according to the present invention.
Figure 5:
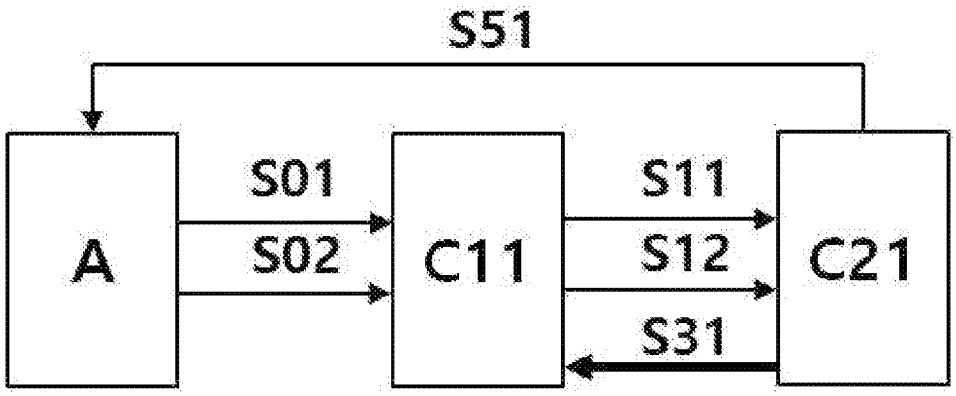
FIG. 5 is a view showing a paper feed system according to an embodiment of the present invention.
Figure 6:
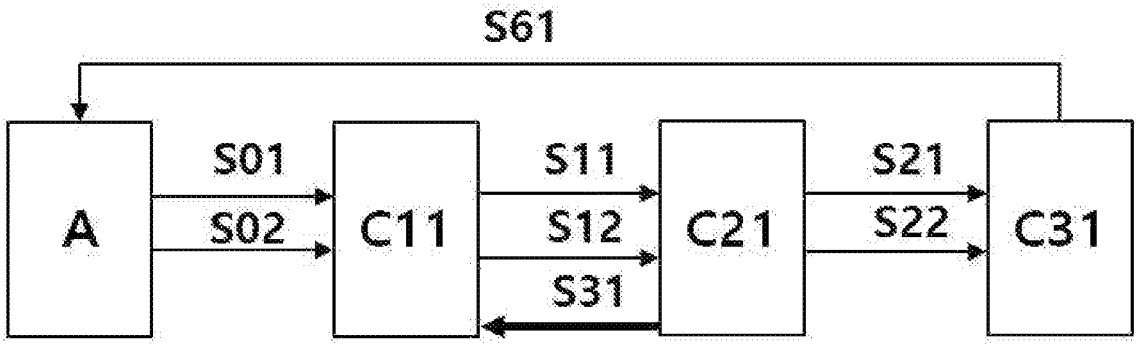
FIG. 6 is a view showing a paper feed system according to another embodiment of the present invention.

Of the accompanying drawings, FIG. 1 is a perspective view showing a paper feed apparatus according to the present invention, FIG. 2 is an exploded perspective view showing the paper feed apparatus according to the present invention, FIG. 3 is a view showing the 'power unit' of the paper feed apparatus according to the present invention, FIGS. 4A-4C are front views showing the lifting operation of the 'paper support plate' of the paper feed apparatus according to the present invention, and FIGS. 5 and 6 are views showing paper feed systems according to the present invention.

As shown in FIGS. 1 to 6, the paper feed system according to the present invention includes: a paper feed apparatus A configured to accommodate stacked paper and sense a paper shortage state and a paper replenishment completion state; a communication unit C11 provided to correspond to the paper feed apparatus, and configured to transmit a paper replenishment request signal when the paper feed apparatus senses a paper shortage state and to transmit a paper replenishment completion signal when the paper feed apparatus senses a paper replenishment completion state; and a first server C21 configured to communicate with the communication unit C11 over a communication network N1.

Furthermore, the paper feed system according to the present invention may further include a second server C21 configured to communicate with the first server C21 over the communication network N1. When receiving a paper replenishment request signal S11 from the communication unit C11, the first server C21 transmits a paper feed service provision signal S41 to the second server C31.

The paper feed apparatus A includes: a main body 100 configured such that a paper outlet 101 is formed in the upper part of the front side, a space is formed therein, and a door 102 configured to be selectively opened and closed is formed in the front side; a paper support plate 200 formed in a plate shape so that paper is stacked and supported thereon; an elevation unit installed inside the main body 100 and configured to selectively elevate and lower the paper support plate 200; a power unit 400 mounted in the lower part of the main body, and configured to move the paper support plate 200; a sensor S configured to measure the weight of paper stacked on the paper support plate 200; and a controller 500 configured to control the driving of the power unit 400 in conjunction with the sensor S.

The elevation unit includes: a plurality of guide rails 120 formed inside the main body 100 in a vertical direction; a plurality of guide rods 140 formed inside the main body 100 in a vertical direction and arranged in parallel with the guide rails 120; and a multi-stage screw 300 formed under the paper support plate 200 formed in a plate shape so that paper is stacked and supported thereon.

A plurality of bushings 220 configured to be fitted around the guide rods 140 are formed in the paper support plate 200, insertion recesses 240 configured to be coupled to the guide rails 120 are formed in the paper support plate 200, and the multi-stage screw 300 is formed at the bottom of the paper support plate 200.

There are included a power unit 400 including a motor 420 mounted in the lower part of the main body 100 and provided with a driving pulley 430, a driven pulley 440 formed at the lower end of the multi-stage screw 300, and a chain 450 configured to connect the driving pulley 430 and the driven pulley 440; a sensor S configured to measure the weight of the paper stacked on the paper support plate 200;

and a controller 500 configured to control the driving of the power unit 400 in conjunction with the sensor S.

When the sensor S detects a change in the weight of the stacked paper, the controller 500 elevates the paper support plate 200 in association with the moving distance calculated according to the reduction in the weight by driving the motor 420 to extend the multi-stage screw 300. Accordingly, the paper support plate 200 selectively moves up and down while supporting the paper, so that a predetermined amount of paper is partially drawn out through the paper outlet 101 when it is necessary to replenish a copier, a printer, and an all-in-one printer, and thus a user may conveniently remove and use paper.

The main body 100 is formed in a rectangular parallelepiped shape having an internal space so that a large amount of paper can be stacked and stored in a vertical direction, and the paper outlet 101 is formed in the upper portion of the front surface so that the user can open the paper outlet 101 and take out the inner paper. Meanwhile, a locking device 122 may be additionally formed in the paper outlet 101 so that the use of the paper may be managed.

The door 102 is coupled to the front of the main body 100 to be selectively opened and closed so that paper can be filled therein.

A heating device (not shown) configured to prevent moisture may be provided inside the main body 100. The heating device can prevent paper from being deformed due to moisture.

The power unit 400 is connected to the multi-stage screw 300, and is operated to selectively extend and reduce the length of the multi-stage screw 300.

The power unit 400 includes the motor 420 mounted in the lower part of the main body 100 and provided with the driving pulley 430, the driven pulley 440 formed at the lower end of the multi-stage screw 300, and the chain 450 configured to connect the driving pulley 430 and the driven pulley 440.

The multi-stage screw 300 includes a first-stage screw 310 connected to the driven pulley 440 and provided with a thread that is formed on the outer circumferential surface thereof, a second-stage screw 320 screwed to the first-stage screw 310 and provided with a thread that is formed on the outer circumferential surface thereof, a third-stage screw 330 screwed to the second-stage screw 320 and provided with a thread that is formed on the outer circumferential surface thereof, and a screw housing 340 screwed to the outside of the third-stage screw 330 and provided with a top end that is fixed to the paper support plate 200. Accordingly, the first-stage screw 310 is coupled to the shaft of the driven pulley 440, and the driven pulley 440 is connected to the driven pulley 430 by the chain 450.

Thereafter, when the motor 420 is driven to rotate, the driven pulley 440 connected by the chain 450 is rotated in conjunction with the rotation of the main pulley 430, and the first-stage screw 310 connected to the driven pulley 440 is rotated clockwise or counterclockwise.

When the motor 420 of the power unit 400 is rotated in response to a drive signal from the controller 500, the second-stage screw 320 is raised when the first-stage screw 310 is rotated clockwise. At the time at which the raising of the second-stage screw 320 ends, the third-stage screw 330 is rotated together with the first-stage screw 310 and is raised. Accordingly, since the paper support plate 200 is elevated by the raising of the second-stage screw 320 and the third-stage screw 330, paper may be moved upward.

The paper support plate 200 may move stably in a state of being coupled to the guide rails 120 and guide rods 140 to prevent shaking during an elevation operation.

The guide rails 120 are installed symmetrically and vertically on both sides of the inner side of the main body 100, and the insertion recesses 240 into which the guide rails 120 are inserted are formed at both corners of the paper support plate 200.

The guide rods 140 are disposed in vertical directions parallel to the guide rails 120, and are coupled through the paper support plate 200.

The paper support plate 200 is provided with the bushings 220 so that the guide rods 140 penetrate and slide stably during an elevation operation. The bushings 220 are each formed in a cylindrical shape having upper and lower openings.

Furthermore, since an end of the paper is supported by the guide rails 120 and the guide rails 120 serve as protective guards, damage to the paper may be reduced by reducing the frictional force between contact surfaces.

Meanwhile, the elevation unit is mounted inside the main body 100 and selectively elevates and lowers the paper support plate 200. However, the elevation unit is not limited thereto, but includes any configuration configured to move the paper support plate 200 up and down.

Meanwhile, when the amount of paper loaded on the paper support plate 200 decreases, the sensor S detects the decrease in load, and the controller 500 operates the power unit in association with the decrease in weight detected by the sensor. That is, the multi-stage screw 300 is extended by driving the motor 420, and thus the paper support plate 200 is moved upward in association with the moving distance calculated based on the decrease in weight. Paper has a predetermined weight depending on itself. The number of pages of paper discharged may be calculated through the decrease in the weight of paper. Therefore, the number of pages of paper discharged is calculated by the reduced weight, the height of the paper discharged, i.e., the moving distance, is calculated through the calculated number of pages, and the paper support plate 200 is elevated in association with the moving distance according to the reduction in weight.

Furthermore, the controller 500 further includes a height detecting unit 540 configured to detect whether the paper support plate 200 reaches a desirably set remaining amount height. The controller 500 transmits a paper shortage signal S01 to the communication unit C11 when the height detection unit 540 detects a situation in which the paper support plate 200 reaches the set remaining amount height.

When the amount of paper loaded on the paper support plate 200 decreases, the sensor S detects the decrease in load. When the height sensor 540 of the controller 500 detects a situation in which the paper support plate 200 reaches the set remaining amount height in association with the decrease in weight detected by the sensor, the controller 500 transmits a paper shortage signal S01 to the communication unit C11 to provide notification that it is time to fill paper.

The controller 500 transmits a paper shortage signal S01 to the communication unit C11, the communication unit C11 transmits the paper replenishment request signal to the first server C21, and the first server C21 feeds paper in response to the request signal or transmits a paper feed service provision signal to the second server C31. Accordingly, paper feed may be made convenient by automatically requesting an order.

The operation process of the present invention will be described with reference to FIGS. 4A to 6 as follows:

As shown in FIG. 4A, paper is completely filled. In the process of filling stacked paper, the paper support plate 130 continues to be lowered depending on the reverse rotation of the multi-stage screw 300 by the operation of the motor 420.

The operation of the motor 420 is stopped until the weight of the paper support plate 130 is measured and reaches an appropriate weight, and paper is filled. Meanwhile, a lower detection unit L1 may be further formed in the lower part of the inside of the main body 100. The controller 500 stops the operation of the motor 420 when the lower detection unit L1 detects a situation in which the paper support plate 130 reaches a freely set lower set height, thereby preventing the paper support plate 130 from being lowered below the lower set height.

As shown in FIG. 4B, when a predetermined amount of paper is removed and thus a small amount of paper is exhausted, the motor 420 is operated in response to the detection of a change in weight by the sensor S and an operation signal from the controller 500, and thus the multi-stage screw 300 is rotated, thereby causing the paper support plate 200 to be raised. Since the number of pages of paper discharged is calculated by the reduced weight, the height of the paper discharged is calculated to calculate the moving distance, and the paper support plate 200 is raised by the calculated moving distance. When the paper support plate 200 is raised by the moving distance, the operation of the motor 420 is stopped.

Therefore, when a predetermined amount of paper is discharged, the paper support plate is raised by a change in weight so that paper is always placed in the paper outlet 101 and is ready to be discharged at all times.

The controller 500 further includes a height detection unit 540 configured to detect whether the paper support plate 200 reaches a freely set remaining amount height. As shown in FIG. 4C, when the paper on the paper support plate 200 is gradually exhausted and the height detection unit 540 of the controller 500 detects a situation in which the paper support plate 200 reaches a set remaining amount height, the controller 500 transmits a paper shortage signal S01 to the communication unit C11 to providing notification that it is time to fill paper.

Referring to FIG. 5, a paper feed system according to an embodiment of the present invention includes a paper feed apparatus A and a first server C21.

The controller 500 of the paper feed apparatus A senses a shortage of stacked paper and the completion of paper replenishment through the height detection unit 540.

When a paper shortage stage is sensed in step S01, the communication unit C11 transmits a paper replenishment request signal S11 to the first server C21 over the communication network N1.

When a company that rents, provides, or manages the paper feed apparatus A where the first server C21 is located checks the paper replenishment request signal S11 through the first server C21, the company checks information about the paper feed apparatus A, and then feeds paper offline in step S51. Furthermore, when a paper replenishment completion state is sensed by the paper feed apparatus A in step S02 in a state in which the paper feed apparatus A has been replenished with paper, the communication unit C11 transmits a paper replenishment completion signal to the first server C21 through the communication network N1 depending on the detection in step S12.

When the replenishment of paper is completed by a paper supplier and the paper feed apparatus A senses a paper replenishment completion state, the communication unit C11 transmits a paper replenishment completion signal S12 to the first server C21, so that the first server (C21) side can be notified that paper replenishment is completed in the corresponding paper feed apparatus A.

When the first server C21 receives the paper replenishment request signal S11 from the communication unit C11, it feeds paper to the paper feed apparatus A offline in step S51. The first server C21 and the communication unit C11 are connected over a communication network. Meanwhile, the first server C21 and the communication unit C11 may be connected to communicate through access points AP1 and AP2 (not shown).

The communication network is a network connected for the purpose of enabling communication between terminal users. The communication network is connected to one or more terminals, links, terminal nodes, network switches, exchanges, and/or nodes, and/or the like, and enables electrical communication. The communication network includes wired and wireless communication networks such as 3G, 4G, LTE, Bluetooth, Wi-Fi, ZigBee, NFC, RFID, Ethernet, ISDN, NGN, NPL network, VPN, MAN, switch, router, overlay, Epanet, BINET, Internet, intranet, local area network (LAN), wide area networks (WAN), storage area networks (SAN), cell, and/or satellite networks, and/or combinations thereof, but are not limited thereto.

A short-range communication module (not shown) may be provided between the communication unit C11 and the paper feed apparatus A to provide notification of a result from the paper feed apparatus A to the communication unit C11 when a paper replenishment request state or a paper replenishment completion state is sensed. The short-distance communication method used herein may be, e.g., Bluetooth, ZigBee, VPN, or Wi-Fi, but is not limited thereto.

Meanwhile, when receiving the paper replenishment request signal S11, the first server C21 may transmit a paper payment request signal S31 to the communication unit C11. When the paper payment request signal S31 is transmitted, a payment-related window on a web browser may pop up on the communication unit C11 or a separate payment-related program may be executed. When payment is completed by the manager of the communication unit C11, a payment completion state may be checked in real time on the first server C21. When the manager of the first server C21 becomes aware that payment has been completed by checking paper payment-related information checked on the first server C21 after the payment by the manager of the communication unit C11, paper is finally fed offline by the manager of the first server C21 in step S51. The manager of the communication unit C11 may make a payment using CMS automatic transfer as a default, but a payment method is not limited thereto.

Referring to FIG. 6, a paper feed system according to another embodiment of the present invention includes a paper feed apparatus A, a first server C21 and a second server C31.

According to another embodiment of the present invention, when a company that rents, provides or manages the paper feed apparatus A in which the first server C21 is located receives a paper replenishment request signal S11 through the first server C21, the first server C21 transmits a paper feed service provision signal S21 to a paper manufacturer or paper supplier where the second server C31 is located. When the paper manufacturer or paper supplier where the second server C31 is located checks the paper feed service provision signal S21 through the first server C21, the paper manufacturer or paper supplier checks information about the corresponding paper feed apparatus A, and feeds the paper offline in step S61. When the replenishment of the paper is completed by the paper supplier and the paper feed apparatus A senses a paper replenishment completion state, the communication unit C11 transmits a paper replenishment completion signal S12 to the first server C21 and the server C21 transmits a paper feed service completion signal S22 to the second server C31, so that the second server C31 can be notified that the paper feed apparatus A is in a state in which paper replenishment has been completed.

When receiving the paper replenishment request signal S11, the first server C21 may transmit a paper feed service provision signal S21 to the second server C31 and, at the same time, transmit a paper payment request signal to the communication unit C11 in step S31. Unlike this, when receiving the paper replenishment request signal S11, the first server C21 may first transmit the paper payment request signal S31 to the communication unit C11 while holding off the transmission of the paper feed service provision signal S21. First, when the paper payment request signal S31 is transmitted, a payment-related window on a web browser may pop up on the communication unit C11, or a separate payment-related program may be executed. When payment is completed by the manager of the communication unit C11, a payment completion state may be checked in real time on the first server C21. When the manager of the first server C21 becomes aware that the payment has been completed by checking the paper payment-related information checked on the first server C21 after the payment by the manager of the communication unit C11, the first server C21 is allowed to transmit a paper feed service provision signal S21 from the first server C21 to the second server C31, and paper is fed offline in step S61. The manager of the communication unit C11 may make a payment using CMS automatic transfer as a default, but a payment method is not limited thereto.

In the first server C21 and the second server C31, information related to the paper feed apparatus A is stored in advance. The related information may include, e.g., the serial number of the paper feed apparatus A, the address where the paper feed apparatus A is located, the manager's name, the manager's phone number, the IP address of the communication unit C11 connected to the paper feed apparatus A, and/or the like. When the information related to the corresponding paper feed apparatus A is stored in advance as described above, a configuration may be made such that the paper feed service provision signal S21 and the paper payment request signal S31 can be automatically transmitted without the intervention of the manager of the first server C21.

In addition, although not specifically shown in the drawings, the first server C21 and the second server C31 are configured to communicate with each other over a wired or wireless communication network. For example, the first server C21 may be located in a company that rents, provides, or manages the paper feed apparatus A or at a place that can be checked at all times, and the second server C31 may be located in a paper manufacturer or a paper supplier or at a place that can be checked at all times. Furthermore, a configuration may be made to enable communication between the first server C21 and a smartphone of the manager of the first server C21 so that checking can be performed in a management app installed on the smartphone of the manager of the first server C21. Furthermore, a configuration may be made to enable communication between the second server C31 and a smartphone of the manager of the second server C31 so that checking can be performed in a management app installed on the smartphone of the manager of the second server C31.

In a paper feed system according to an embodiment of the present invention, one communication unit C11 may be connected to and used in conjunction with a plurality of paper feed apparatuses. That is, a plurality of paper feed apparatuses 10*a*, 10*b*, 10*c*, . . . , 10*m*, and 10*n* connected in common to the communication unit C11 are connected to communicate over a communication network N1. When a paper shortage stage is sensed in any one of the paper feed apparatuses 10*a*, 10*b*, 10*c*, . . . , 10*m*, and 10*n*, a series of processes may be performed as described in conjunction with FIG. 6 above.

The present invention is not limited by the above-described embodiments and the accompanying drawings. Various modifications and applications not illustrated may be made within the scope of the technical spirit of the present invention, and the substitution of components and changes to other equivalent embodiments may also be made. Therefore, such modifications and applications related to the features of the present invention should be construed as being included within the scope of the present invention.

The invention claimed is:

1. A paper feed system comprising:

a paper feed apparatus configured to accommodate stacked paper and sense a paper shortage state and a paper replenishment completion state;

a communication unit provided to be integrated with or correspond to the paper feed apparatus, and configured to transmit a paper replenishment request signal when the paper feed apparatus senses a paper shortage state and transmit a paper replenishment completion signal when the paper feed apparatus senses a paper replenishment completion state;

a first server configured to communicate with the communication unit over a communication network; and a second server configured to communicate with the first server over a communication network;

wherein the paper feed apparatus comprises:

a main body configured such that a paper outlet is formed in an upper part of a front side thereof, a space is formed therein, and a door configured to be selectively opened and closed is formed in the front side thereof;

a paper support plate formed in a plate shape so that paper is stacked and supported thereon;

an elevation unit installed inside the main body, and configured to selectively elevate and lower the paper support plate;

a power unit mounted in a lower part of the main body, and configured to move the paper support plate;

a sensor configured to measure a weight of the paper stacked on the paper support plate; and a controller configured to control driving of the power unit in conjunction with the sensor; and wherein the first server:

transmits a paper payment request signal to the communication unit in response to the paper replenishment request signal when receiving the paper replenishment request signal from the communication unit; and transmits a paper feed service provision signal to the second server when determining that payment is completed in response to the paper payment request signal, wherein the elevation unit comprises:

a plurality of guide rails formed inside the main body in a vertical direction;

a plurality of guide rods formed inside the main body in a vertical direction, and arranged in parallel with the guide rails; and a multi-stage screw formed under the paper support plate.

2. The paper feed system of claim 1, wherein the first server transmits a paper feed service provision signal to the second server when receiving the paper replenishment request signal from the communication unit.

3. The paper feed system of claim 1, wherein the multi-stage screw comprises:

a first-stage screw connected to a driven pulley, and provided with a thread that is formed on an outer circumferential surface thereof;

a second-stage screw screwed to the first-stage screw, and provided with a thread that is formed on an outer circumferential surface thereof;

a third-stage screw screwed to the second-stage screw, and provided with a thread that is formed on an outer circumferential surface thereof; and a screw housing screwed to an outside of the third-stage screw, and provided with a top end that is fixed to the paper support plate.

4. The paper feed system of claim 1, wherein the power unit comprises:

a motor mounted in a lower part of the main body, and provided with a driving pulley;

the driven pulley formed at a lower end of the multi-stage screw; and a chain configured to connect the driving pulley and the driven pulley.

5. The paper feed system of claim 1, wherein:

the controller further comprises a lower detection unit configured to detect whether the paper support plate reaches a lower set height; and the controller stops an operation of the motor when the lower detection unit detects a situation in which the paper support plate reaches the lower set height.

6. The paper feed system of claim 1, wherein a plurality of bushings configured to be fitted around the guide rods are formed in the paper support plate, and insertion recesses configured to be coupled to the guide rails are formed in the paper support plate.

7. A paper feed system comprising:

a paper feed apparatus configured to accommodate stacked paper and sense a paper shortage state and a paper replenishment completion state;

a communication unit provided to be integrated with or correspond to the paper feed apparatus, and configured to transmit a paper replenishment request signal when the paper feed apparatus senses a paper shortage state and transmit a paper replenishment completion signal when the paper feed apparatus senses a paper replenishment completion state;

a first server configured to communicate with the communication unit over a communication network; and a second server configured to communicate with the first server over a communication network;

wherein the paper feed apparatus comprises:

a main body configured such that a paper outlet is formed in an upper part of a front side thereof, a space is formed therein, and a door configured to be selectively opened and closed is formed in the front side thereof;

a paper support plate formed in a plate shape so that paper is stacked and supported thereon;

an elevation unit installed inside the main body, and configured to selectively elevate and lower the paper support plate;

a power unit mounted in a lower part of the main body, and configured to move the paper support plate;

a sensor configured to measure a weight of the paper stacked on the paper support plate; and a controller configured to control driving of the power unit in conjunction with the sensor; and wherein the first server:

transmits a paper payment request signal to the communication unit in response to the paper replenishment request signal when receiving the paper replenishment request signal from the communication unit; and transmits a paper feed service provision signal to the second server when determining that payment is completed in response to the paper payment request signal, wherein the controller, when the sensor detects a change in a weight of the stacked paper, elevates the paper support plate in association with a moving distance calculated according to a reduction in weight by driving the motor to extend a multi-stage screw.

8. A paper feed system comprising:

a paper feed apparatus configured to accommodate stacked paper and sense a paper shortage state and a paper replenishment completion state;

a communication unit provided to be integrated with or correspond to the paper feed apparatus, and configured to transmit a paper replenishment request signal when the paper feed apparatus senses a paper shortage state and transmit a paper replenishment completion signal when the paper feed apparatus senses a paper replenishment completion state;

a first server configured to communicate with the communication unit over a communication network; and a second server configured to communicate with the first server over a communication network;

wherein the paper feed apparatus comprises:

a main body configured such that a paper outlet is formed in an upper part of a front side thereof, a space is formed therein, and a door configured to be selectively opened and closed is formed in the front side thereof;

a paper support plate formed in a plate shape so that paper is stacked and supported thereon;

an elevation unit installed inside the main body, and configured to selectively elevate and lower the paper support plate;

a power unit mounted in a lower part of the main body, and configured to move the paper support plate;

a sensor configured to measure a weight of the paper stacked on the paper support plate; and a controller configured to control driving of the power unit in conjunction with the sensor; and wherein the first server:

transmits a paper payment request signal to the communication unit in response to the paper replenishment request signal when receiving the paper replenishment request signal from the communication unit; and transmits a paper feed service provision signal to the second server when determining that payment is completed in response to the paper payment request signal, wherein:

the controller further comprises a height detecting unit configured to detect whether the paper support plate reaches a desirably set remaining amount height; and the controller transmits a paper shortage signal to the communication unit when the height detection unit detects a situation in which the paper support plate reaches the set remaining amount height.

* * * * *